US007999666B2

(12) United States Patent
Barrieau et al.

(10) Patent No.: US 7,999,666 B2
(45) **Date of Patent: *Aug. 16, 2011**

(54) EMERGENCY LIGHTING SYSTEM WITH IMPROVED MONITORING

(75) Inventors: Mark B. Barrieau, Baldwinville, MA (US); Johnpaul P. Barrieau, Gardner, MA (US); Jeffrey R. Brooks, Ashburnham, MA (US)

(73) Assignee: SimplexGrinnell LP, Westminster, MA (US)

( * ) Notice: Subject to any disclaimer, the term of this patent is extended or adjusted under 35 U.S.C. 154(b) by 490 days.

This patent is subject to a terminal disclaimer.

(21) Appl. No.: 12/172,014

(22) Filed: Jul. 11, 2008

(65) Prior Publication Data

US 2008/0266076 A1 Oct. 30, 2008

Related U.S. Application Data

(63) Continuation-in-part of application No. 10/934,711, filed on Sep. 3, 2004, now Pat. No. 7,400,226.

(60) Provisional application No. 60/502,338, filed on Sep. 12, 2003.

(51) Int. Cl.

| | |
|---|---|
| ***G08B 29/00*** | (2006.01) |
| *G08B 17/00* | (2006.01) |
| *G08B 5/00* | (2006.01) |
| *G09F 25/00* | (2006.01) |

(52) U.S. Cl. ..... 340/506; 340/628; 340/286.01; 340/331; 340/511

(58) Field of Classification Search ..... 340/506, 340/628, 286.01, 331

See application file for complete search history.

(56) References Cited

U.S. PATENT DOCUMENTS

| | | | | |
|---|---|---|---|---|
| 4,163,218 | A | 7/1979 | Wu | |
| 4,255,746 | A | 3/1981 | Johnson et al. | |
| 4,258,291 | A | 3/1981 | Scott et al. | |
| 4,524,304 | A | 6/1985 | Todd | |
| 4,567,557 | A | 1/1986 | Burns | |
| 4,799,039 | A | 1/1989 | Balcom et al. | |
| 4,977,353 | A | 12/1990 | Helal et al. | |
| 5,154,504 | A | 10/1992 | Helal et al. | |
| 5,349,330 | A | 9/1994 | Diong et al. | |
| 5,397,963 | A | 3/1995 | Manson | |
| 5,446,439 | A | 8/1995 | Kramer et al. | |
| 5,666,029 | A | 9/1997 | McDonald | 315/86 |
| 5,815,068 | A | 9/1998 | Vadseth | |
| 6,028,513 | A | 2/2000 | Addy | |
| 6,285,132 | B1 | 9/2001 | Conley, III et al. | |
| 6,426,697 | B1 | 7/2002 | Capowski et al. | |
| 6,502,044 | B1 | 12/2002 | Lane et al. | |
| 6,529,128 | B2 | 3/2003 | Weng | |
| 6,538,568 | B2 | 3/2003 | Conley, III | |
| 7,012,544 | B2 | 3/2006 | Cunningham et al. | |
| 7,026,768 | B1 | 4/2006 | Ruiz | |
| 7,123,130 | B2 | 10/2006 | Bolta | |
| 7,321,302 | B2 * | 1/2008 | Beghelli | 340/540 |
| 7,400,226 | B2 * | 7/2008 | Barrieau et al. | 340/286.01 |
| 2006/0139161 | A1 * | 6/2006 | Beghelli | 340/514 |
| 2008/0143539 | A1 * | 6/2008 | McSheffrey et al. | 340/584 |

* cited by examiner

*Primary Examiner* — George Bugg
*Assistant Examiner* — Jack Wang
(74) *Attorney, Agent, or Firm* — Brinks Hofer Gilson & Lione

(57) ABSTRACT

An emergency lighting unit includes a lamp, a backup battery, controller, and a network interface. The controller connects the backup battery to the lamp upon detection of an emergency condition and loss of main power. The network interface interfaces with and receives commands from a fire alarm control panel via a fire alarm network. Each emergency lighting unit may have a unique identifier with respect to the fire alarm network.

23 Claims, 5 Drawing Sheets

4120 Runtime Emergency Lighting Test Report

West Campus Network Node 6, McCain Residence Hall Report Date: 07/01/08

| Device | Label | Last Test Date | Test Type | Test Result | Prev. 90 min Test | Test Result |
|---|---|---|---|---|---|---|
| M1-1 | 1st Floor Exit Sign #1 | 05/27/08 | 30 day | PASS | 04/18/08 | PASS |
| M1-2 | 1st Floor Egress #8 | 05/28/08 | 30 day | PASS | 04/19/08 | PASS |
| M1-3 | 1st Floor Egress #7 | 05/29/08 | 30 day | PASS | 04/20/08 | PASS |
| M1-4 | 1st Floor Egress #6 | 06/01/08 | 30 day | PASS | 04/21/08 | PASS |
| M1-5 | 1st Floor Exit Sign #2 | 06/02/08 | 30 day | PASS | 04/22/08 | PASS |
| M1-6 | 1st Floor Egress #5 | 06/03/08 | 30 day | PASS | 04/23/08 | PASS |
| M1-7 | 1st Floor Landing Egress | 06/30/08 | 90 min | FAIL | 01/04/08 | PASS |
| M1-8 | 2nd Floor Exit Sign #1 | 06/29/08 | 90 min | PASS | 01/03/08 | PASS |
| M1-9 | 2nd Floor Egress #8 | 06/28/08 | 90 min | PASS | 01/02/08 | PASS |
| M1-10 | 2nd Floor Egress #7 | 06/27/08 | 90 min | PASS | 01/01/08 | PASS |
| M1-11 | 2nd Floor Egress #6 | 06/26/08 | 90 min | PASS | 12/31/07 | PASS |

FIG. 4

EMERGENCY LIGHTING SYSTEM WITH IMPROVED MONITORING

RELATED APPLICATIONS

This application is a continuation-in-part of U.S. application Ser. No. 10/934,711 filed Sep. 3, 2004, (now U.S. Pat. No. 7,400,226), which claims the benefit of U.S. Provisional Application No. 60/502,338, filed Sep. 12, 2003. The entire teachings of the above applications are incorporated herein by reference.

BACKGROUND

Emergency lighting systems are dependent on battery backup to provide egress lighting when AC power has failed. Presently, emergency lighting units are provided with manual test capability. Typically, these units provide a test switch, or other manual means for initiating a test, which is held in the "ON" position for 90 seconds each month. The battery is tested by applying a load for the duration in which the switch is pressed.

This method of battery test is inadequate to properly measure actual battery capacity. For example, a given unit loads the battery with 1 Ampere during the 90 second load test. This is the same as the emergency lighting load. This load represents only a 0.025 Ampere-hour (Ah) discharge, and is not really an adequate representation of battery condition, since the actual system will be required to provide 90 minutes standby. Additionally, an annual test is intended to be done in order to measure actual battery capacity by fully discharging the batteries. This test requires significant labor, since a building can have many emergency lighting components.

U.S. Pat. No. 6,538,568, to Conley III, entitled "EMERGENCY LIGHTING REMOTE MONITORING AND CONTROL SYSTEM" teaches an emergency lighting unit identified by unique ID numbers. The unit communicates via wireless means with a central controller. Various commands from the central controller may include turning the lamp on and off, requesting a status, or initiating a battery voltage and lamp current tests.

BRIEF SUMMARY

Integration of Emergency Lighting Individual Addressable Modules (ELIAMs) according to an embodiment of the present invention with a fire alarm system allows for better monitoring at lower service cost. Automation of the test cycle is provided. Backup of a depleted battery following the test is provided by a signaling line circuit (SLC). This enables continuous monitoring of battery condition. Required monthly testing may be eliminated. Annual test requirements can be met monthly. A system trouble condition and annunciation via the fire alarm network or other means can provide notice that a specific battery requires replacement.

Integration of emergency lighting functions with a fire alarm system may be advantageous because the fire alarm system provides a higher level of monitoring than is typically provided by an emergency lighting system. The fire alarm system (using the fire alarm control panel) may work in combination with one or more ELIAMs in order to improve the configuration, testing, documenting, and operation of the emergency lighting system.

The fire alarm system (such as a fire alarm control panel) may send one or more commands to the ELIAM. Examples of commands sent from the fire alarm system may include: (1) a configuration command; (2) a testing command; (3) a status command; and (4) an operation command. A configuration command may include data used by the ELIAM to configure itself. The configuration command may be sent at any time during the operational life of the ELIAM, such as upon initial configuration. A testing command may be sent by the fire alarm system in order to command the ELIAM to test at least a part of itself (such as the battery in the ELIAM). The testing command may be interpreted by the ELIAM as a command to perform an immediate test or as a command to perform a test at a future time. The ELIAM may thereafter send the test data to the fire alarm control panel. A status command may include a request by the fire alarm system to inquire about the status of any aspect of the ELIAM. The ELIAM may send its status data to the fire alarm system in response to the status command. Finally, an operation command may include one or more commands to dictate the operation of the ELIAM.

An ELIAM according to an embodiment of the present invention communicates with a fire alarm control panel using a network, such as a pre-existing fire alarm network. The fire alarm control panel may send one or more commands to the ELIAM(s) in the system. The ELIAM monitors battery capacity by fully discharging a battery at regular intervals. The ELIAM may record test data related to any aspect of the ELIAM, such as any power aspect of the ELIAM. Examples of power aspects include, but are not limited to: the battery; the lamp; and the primary power. For example, the ELIAM may test the battery to generate test data, such as test data that provides an indication of the battery capacity. One example of an indicator of the battery capacity may include the ampere hours rating of the battery. As another example, the ELIAM may test the state of the lamp (such as whether a part of the lamp, such as the bulb is functioning properly). The ELIAM may analyze the current draw during a test, and may determine whether the bulb is burned out based on the level of current drawn. As still another example, the ELIAM may monitor the state of the primary or line power (and provide an indication to the fire alarm control if the primary power is unavailable.

The ELIAM may test the battery in a variety of ways. For example, the ELIAM may discharge the local battery on command from the system controller. The ELIAM monitors battery voltage and current during the discharge, thus providing an actual measurement of battery capacity. The system controller may command the local battery to discharge in direct response to receiving a test command from the fire alarm control panel (discussed below) or may command the local battery to discharge based on its own determination (such as programming local to the ELIAM to test the battery at predetermined intervals).

An emergency lighting unit according to an embodiment of the present invention includes a lamp, a backup battery, and controller and a network interface. The controller connects the backup battery to the lamp upon detection of an emergency condition and loss of main power. The network interface interfaces with and receives commands via a fire alarm network. Each emergency lighting unit may have a unique identifier with respect to the fire alarm network.

As discussed above, the controller for the ELIAM may initiate a test immediately upon receiving a test command (such as a command sent from the fire alarm control panel). The controller may then cause the backup battery to discharge, while sensing the battery's state and forwarding battery state information via the network interface to a network or system controller, such as a fire alarm control panel. The battery state information may include an indication of at least one of: voltage across the battery and current draw from the battery. Other forms of the battery state information may include current times time (such as ampere-hours). Or, the controller may initiate the test based on programming local to the ELIAM (such as the controller accessing a memory on the ELIAM that dictates when the controller is to test the battery, such as at predetermined periods). The programming local to the ELIAM may be configured at manufacture, at installation, or during operation (such as receiving a testing command from the fire alarm control panel to configure a memory in the ELIAM in order to determine when the ELIAM should test the battery).

The backup battery can be discharged through the light source, or alternatively, through a ballast load. Discharge may be for a preset period, or may be controlled by start and end commands received from the network controller. Discharge of the backup battery can also be terminated if the battery's terminal voltage drops below a predetermined threshold, in which case a trouble indication may be sent to the network controller. Troubles may be indicated when battery capacity is not adequate. For example, detection of no or low current during discharge may be interpreted to mean that the lamp is defective.

In at least one embodiment, backup power is delivered via the network while the battery is being discharged. Such backup power may be supplied by the network controller.

The ELIAM may record the test data locally, such as on a volatile or non-volatile memory. The ELIAM may thereafter send the test data to the fire alarm control panel either in response to a received command or on its own accord. For example, the fire alarm control panel may send a command to the ELIAM to send its test data. The ELIAM may, in response to the received command from the fire alarm control panel, send its stored test data to the fire alarm control panel. As another example, the ELIAM may, based on its own determination, send the test data to the fire alarm control panel. Specifically, a memory local to the ELIAM may dictate when the ELIAM is to send its test data to the fire alarm control panel.

Upon receiving the test data, the fire alarm control panel may store the received test data from the ELIAM for analysis or for transmission to another device (as discussed below). For example, the fire alarm control panel (or other system controller or network controller) may maintain a test log, to record the batter capacity of each emergency lighting battery. The test log may correlate the test data to the particular ELIAM that sent the test data.

The fire alarm control panel may thereafter analyze the data from a specific ELIAM (such as the test data or the operation data) or the data from multiple ELIAMs. In analyzing the test data from a specific ELIAM, the fire alarm control panel may analyze the test data in order to determine whether the specific ELIAM is operating properly or configured properly. For example, the fire alarm control panel may analyze the test data to determine whether the battery on the specific ELIAM has enough capacity to provide power so that the ELIAM may operate as it is rated (such as for the ELIAM to provide sufficient illumination for a predetermined period of time). In the event that the ELIAM is determined not to have sufficient capacity to provide power, the fire alarm control panel may notify a central monitoring station. As another example, the fire alarm control panel may analyze the test data to determine whether the lamp on the specific ELIAM is operating properly (such as analyzing the amount of current drawn during the battery test to determine whether the bulb in the lamp is burned out). Again, upon determining a fault in the operation of the ELIAM, the fire alarm control panel may notify a central monitoring station. Alternatively, the ELIAM may analyze its own data locally in order to make these determinations (such as whether the battery has sufficient capacity or whether the bulb is burned out) and may send its conclusions to the fire alarm control panel. The fire alarm panel may thereafter notify the central monitoring station of these faults.

The fire alarm control panel may also analyze the data across multiple ELIAMs. For example, the fire alarm control may analyze the operation data from multiple ELIAMs in order to make determinations about part or all of the emergency lighting system. In particular, the fire alarm control panel may determine that all (or a part) of a building or complex may be without power based on receiving messages from multiple ELIAMs. The fire alarm control panel may analyze the pattern of ELIAMs that report losing primary power to determine whether the loss of primary power is system-wide, or is based on loss of primary power for a specific circuit (such as a set of ELIAMs that correlate to a specific circuit breaker).

The fire alarm control panel may compile the test data from multiple ELIAMs to create a test log for part or all of the emergency lighting system. The fire alarm control panel may use the test log to generate reports, which may be organized based on the preference of the operator or based on local regulations governing emergency lighting systems. The reports may thereafter be transmitted to a central monitoring station.

The emergency lighting unit may be one of plural similar units connected to the network, which each is assigned a unique address. The plural units can be tested, for example, on a periodic rotating schedule. In addition, there can be plural fire alarm appliances, such as smoke detectors, fire detectors, pull stations, intrusion detectors, motion sensors, and audible alarms connected to the network, where each device has been assigned a unique address.

In one embodiment, the emergency lighting unit inhibits the light source from turning on during an emergency condition that would normally cause the light source to be on. As discussed above, one command sent to the emergency lighting unit is an operation command to modify the operation of the emergency lighting device. Thus, the operation of the emergency lighting device may be changed, for example, in response to an operation command from a network controller, and the light source may be inhibited from turning on upon certain conditions; for example, if ambient light is adequate in the vicinity of the unit, that is, sensed ambient light has reached or passed a predetermined threshold; or if no movement has been detected in the vicinity of the unit within some time frame.

In at least one embodiment, a light sensor verifies that the lamp is activated. If the lamp appears not to be activated, the controller reports the detected fault via the network interface.

A method for testing emergency lighting according the present invention comprises: providing a backup battery, such that upon loss of main power, the backup battery supplies power to a lamp; upon receiving a test command from a fire alarm control panel (FACP) via a fire alarm network, discharging the backup battery; and reporting information about the backup battery acquired during discharge to the FACP.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 4 is a table of a test report that may be generated by a fire alarm control panel.

DETAILED DESCRIPTION OF THE PREFERRED EMBODIMENTS

A description of preferred embodiments of the invention follows.

Figure 1:
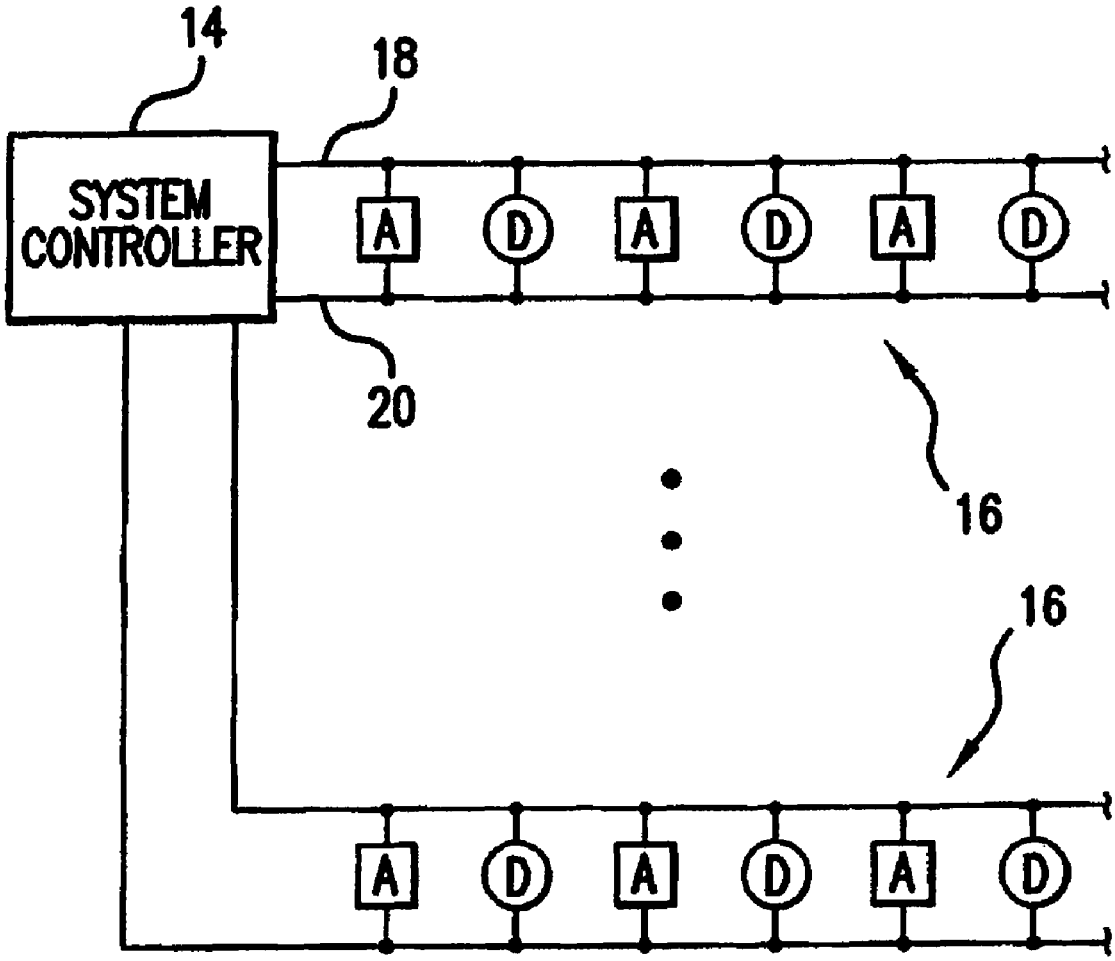
FIG. 1 is a schematic diagram illustrating an exemplary fire alarm network.

FIG. 1 is a schematic diagram illustrating an exemplary fire alarm network. The system includes one or more notification appliance circuits (NACs), i.e., networks 16, having alarm condition detectors D and alarm notification appliances A. Alternatively, the detectors and notification appliances may be on separate networks. The detectors D are monitored by a system controller 14. When an alarm condition is sensed, the system controller 14 signals the alarm to the appropriate notification appliances through one or more networks 16. Notification appliances may include, for example, a visual alarm (strobe), an audible alarm (horn), a speaker, or a combination thereof.

Although not necessary for carrying out the invention, as shown, all of the notification appliances in a network are coupled across a pair of power lines 18 and 20 that advantageously also carry communications between the system controller 14 and the notification appliances A.

Emergency lighting components according to an embodiment of the present invention may be integrated into a networked fire alarm system such as that illustrated in FIG. 1. The fire alarm system may send commands to the emergency lighting components, receive data (including operation and test data) from the emergency light components, analyze the received data, and communicate with devices external to the fire alarm system based on the analyzed data.

One, some or all of the emergency lighting components may be an addressable module within the fire alarm system and may communicate with a system controller over an addressable loop, or signaling line circuit (SLC), i.e., a fire alarm network.

The emergency lighting component is referred to hereafter as an Emergency Lighting Individual Addressable Module (ELIAM). According to one embodiment of the present invention, ELIAMs co-exist with other fire alarm peripherals, e.g., smoke detectors, pull stations, etc.

Each SLC is rated to allow the monitor and control a certain number of addressable modules. For example, in one embodiment, one SLC may allow 250 modules on a single SLC, thirty of which may be ELIAMS. A system may have multiple SLCs. (For example, the system of FIG. 1 has two SLCs 16.) A particular SLC may be designed to support a given number of ELIAMs, which may represent full or partial SLC capacity.

As an example, for a SLC that supports 250 devices, thirty of which may be ELIAMS, a monthly discharge test on each device can be performed. Each day, the system controller may command a single ELIAM to perform a discharge test. The system controller in the ELIAM may command the discharge test based on a command received from a fire alarm control panel. For example, the system controller may begin testing in immediate response to receiving a test command from the fire alarm control panel. Or, the system controller may begin testing based on a command previously sent from the fire alarm control panel. The previously sent command may include information that dictates when, in the future, the system controller should command the testing. For example, the command may indicate that the information in the command dictates that testing be performed monthly. The information dictating the timing of testing may then be stored in a memory accessible by the system controller. Alternatively, the memory accessible by the system controller may be programmed upon manufacture or may be programmed locally upon installation.

The SLC provides backup during the period when the battery is discharged in case of an AC failure during the battery test. The ELIAM converts the network power to the standby source in case of AC failure. Over the course of a month, all thirty devices on the SLC are tested completely. This exceeds the required test schedule, and provides early notification of a defective or depleted battery.

As the battery is discharged, the system may record the discharge current and the battery voltage. Should the battery reach end of capacity, for example, 1.75V per cell with SLA batteries, discharge will cease. The discharge period can be set as desired or as required by local code. For example, many systems require 90-minute backup. In this case, the ELIAM would operate the emergency lights (or, alternately a ballast load simulating the emergency lights) for 90 minutes. If the terminal voltage (1.75V/cell in the example above) is reached before the 90 minutes, a trouble indication may be given and the test may be stopped prior to the end of the 90 minutes. Alternatively, the The system may also verify that the emergency lamp is drawing the expected current draw. For example, if an ELIAM measures no or lower than expected current, it is likely that the emergency lamp is defective or that the bulb has burned out.

Figure 2:
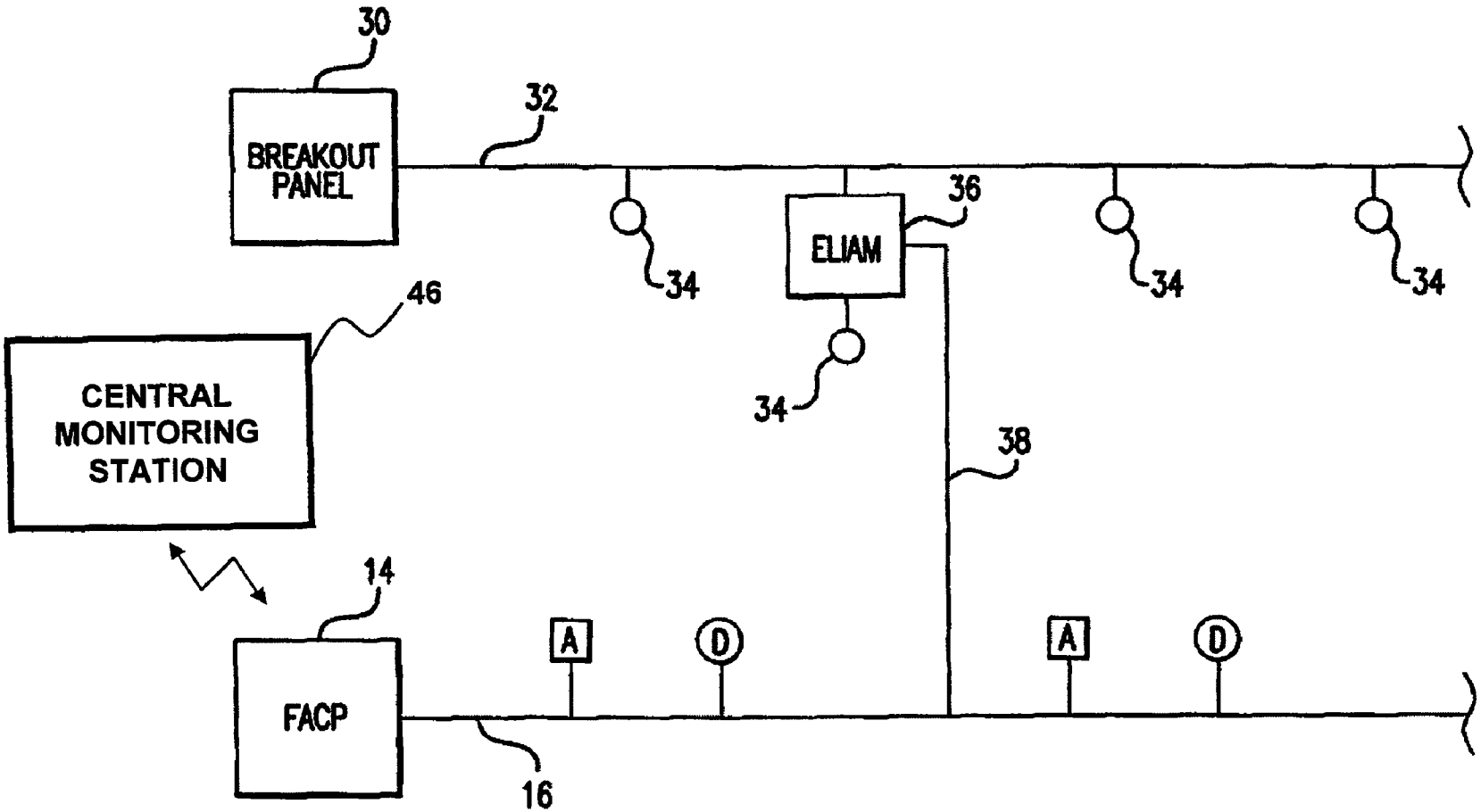
FIG. 2 is a schematic diagram illustrating a system embodying the present invention.

FIG. 2 is a schematic diagram illustrating a system embodying the present invention. For illustrative purposes only, just one SLC 16 is shown, and the single line represents the two wires 18 and 20 of FIG. 1.

A breakout panel 30 supplies power over power line 32 to one or more lights 34, some of which may be designated for emergency lighting. According to an embodiment of the present invention, an ELIAM 36 is attached between the lighting power line 32 and a light 34. The fire alarm network is extended to the ELIAM via connection 38. The ELIAM thus appears to the control panel (system controller) 14 as another network appliance, and can be controlled by, and report to, the control panel 14. The control panel 14 may analyze the data (including test and operation data) sent from the ELIAM 36, may compile reports, and may send the reports to a central monitoring station 46.

Figure 3A:
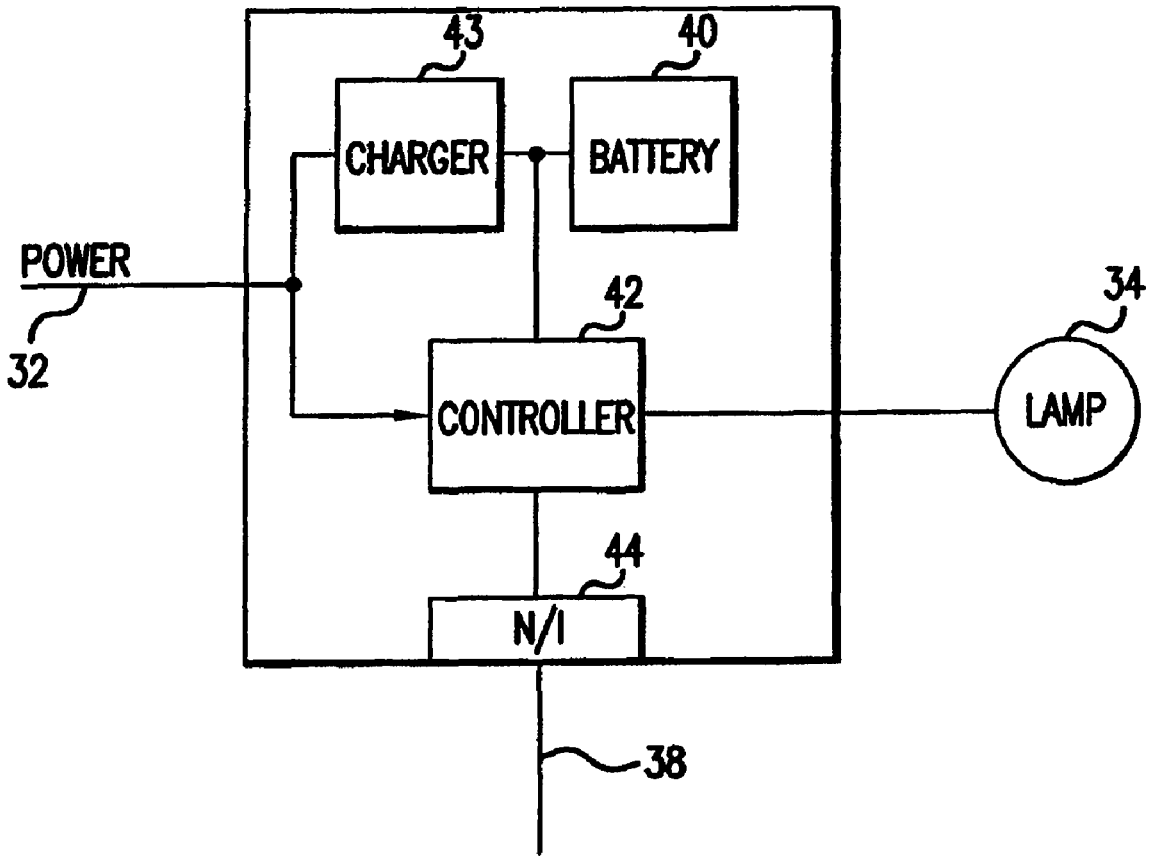
FIG. 3A is a block diagram illustrating a first embodiment of the present invention ELIAM.

FIG. 3A is a block diagram illustrating a first embodiment of the present invention ELIAM. Power is received through power line 32 and is normally routed to power lamp 34. In the event of an AC power loss, a controller 42 causes the lamp 34 to be powered from the backup battery 40.

A network interface 44 connects the unit to the fire alarm network 38. Upon receiving a command via the network interface 44 from the system controller 14 (FIG. 2), the ELIAM controller 42 disconnects the lamp 34 from the power line 32 and instead causes the lamp 34 to be powered from the backup battery 40.

The fire alarm control panel 14 (shown in FIGS. 1 and 2) may send the command to test the backup battery 40 at a variety of times. For example, the fire alarm control panel 14 may send the test command upon commissioning of a building. Specifically, the fire alarm system may initiate a test of all of the emergency lights, collect the data from each light, and organize a report. In this way, the building owner may determine whether there are any defects in materials or workmanship immediately upon commissioning of the building. Alternatively, the timing of the sending of the test command may be programmed according to local regulations.

Thus, upon a command to test the backup battery 40, the battery 40 is discharged through the lamp 34. The battery voltage or current draw may be monitored by the controller 42 and the resulting battery or lamp (no current would imply a faulty lamp) information can then be transmitted to the system controller 14. Alternatively, rather than discharging the battery 40 through the lamp 34, the battery 40 could be discharged through a dummy load (not shown).

The test data generated by the ELIAM may be sent back to the fire alarm control panel 14. The timing of sending the test data may be determined in a variety of ways. For example, the test data may be sent to the fire alarm control panel 14 immediately after generating the test data. Or, the test data generated may be stored on a volatile or non-volatile memory local to the ELIAM. The stored test data may be sent to the fire alarm control panel at a later time (such as dictated by a command previously sent from the fire alarm control panel or dictated by local programming of the ELIAM either upon manufacture or installation).

Upon receiving the test data, the fire alarm control panel 14 may store the received test data from the ELIAM for analysis or for transmission to another device. For example, the fire alarm control panel 14 (or other system controller or network controller) may maintain a test log or a test report, to record the battery capacity of each emergency lighting battery. The test log may correlate the test data to the particular ELIAM that sent the test data. An example of the test report is illustrated in FIG. 4, discussed in more detail below.

The fire alarm control panel 14 may thereafter analyze the data from a specific ELIAM (such as the test data or the operation data) or the data from multiple ELIAMs. In analyzing the test data from a specific ELIAM, the fire alarm control panel 14 may analyze the test data in order to determine whether the specific ELIAM is operating properly or configured properly. For example, the fire alarm control panel 14 may analyze the test data to determine whether the battery on the specific ELIAM has enough capacity to provide power so that the ELIAM may operate as it is rated (such as for the ELIAM to provide sufficient illumination for a predetermined period of time). In the event that the ELIAM is determined not to have sufficient capacity to provide power, the fire alarm control panel 14 may notify a central monitoring station 46. As another example, the fire alarm control panel 14 may analyze the test data to determine whether the lamp on the specific ELIAM is operating properly (such as analyzing the amount of current drawn during the battery test to determine whether the bulb in the lamp is burned out). Again, upon determining a fault in the operation of the ELIAM, the fire alarm control panel 14 may notify a central monitoring station 46. Alternatively, the ELIAM may analyze its own data locally in order to make these determinations (such as whether the battery has sufficient capacity or whether the bulb is burned out) and may send its conclusions to the fire alarm control panel 14. The fire alarm control panel 14 may thereafter notify the central monitoring station 46 of these faults. An example of a report that may be generated by the fire alarm control panel 14 is illustrated in FIG. 4. The report may include: (1) the report date; (2) the identification of the portion of the emergency lighting network (such as "West Campus Network Node 6, McCain Residence Hall"); (3) the identification of the device in the emergency lighting system (such as M1-1); (4) the description of the location of the device (such as the "1st Floor Exit sign #1); (5) the last test date; (6) the test type (such as 30 day or 90 minute); and (7) the result of the test (such as "PASS" or "FAIL"). The report may further include one or more previous tests (such as the previous test date and the result of the test). The test report illustrated in FIG. 4 is merely for illustration purposes. Other information may be included in a test report to comport with reporting requirements in the local code or with the specific reporting requirements of a building owner (such as requirements as dictated by an insurance carrier).

The fire alarm control panel 14 may also analyze the data across multiple ELIAMs. For example, the fire alarm control may analyze the operation data from multiple ELIAMs in order to make determinations about part or all of the emergency lighting system. In particular, the fire alarm control panel 14 may determine that all (or a part) of a building or complex may be without power based on receiving messages from multiple ELIAMs. The fire alarm control panel 14 may analyze the pattern of ELIAMs that report losing primary power to determine whether the loss of primary power is system-wide, or is based on loss of primary power for a specific circuit (such as a set of ELIAMs that correlate to a specific circuit breaker). This information may be sent to the central monitoring station 46 to notify that a circuit breaker has been tripped. In this way, personnel may be notified and the circuit breaker problem may be fixed more quickly, thereby avoiding running down the batteries of the ELIAMs unnecessarily. Alternatively, the fire alarm control panel 14 may forward the data across the multiple ELIAMs to the central monitoring station 46 for the central monitoring station 46 to perform the analysis.

Note that in the embodiment of FIG. 3A, the lamp 34 is external to the ELIAM 36. For example, a pre-existing lamp 34 may be disconnected from a power source with the ELIAM 36 of FIG. 3A being inserted between the power line 32 and the lamp 34.

Figure 3B:
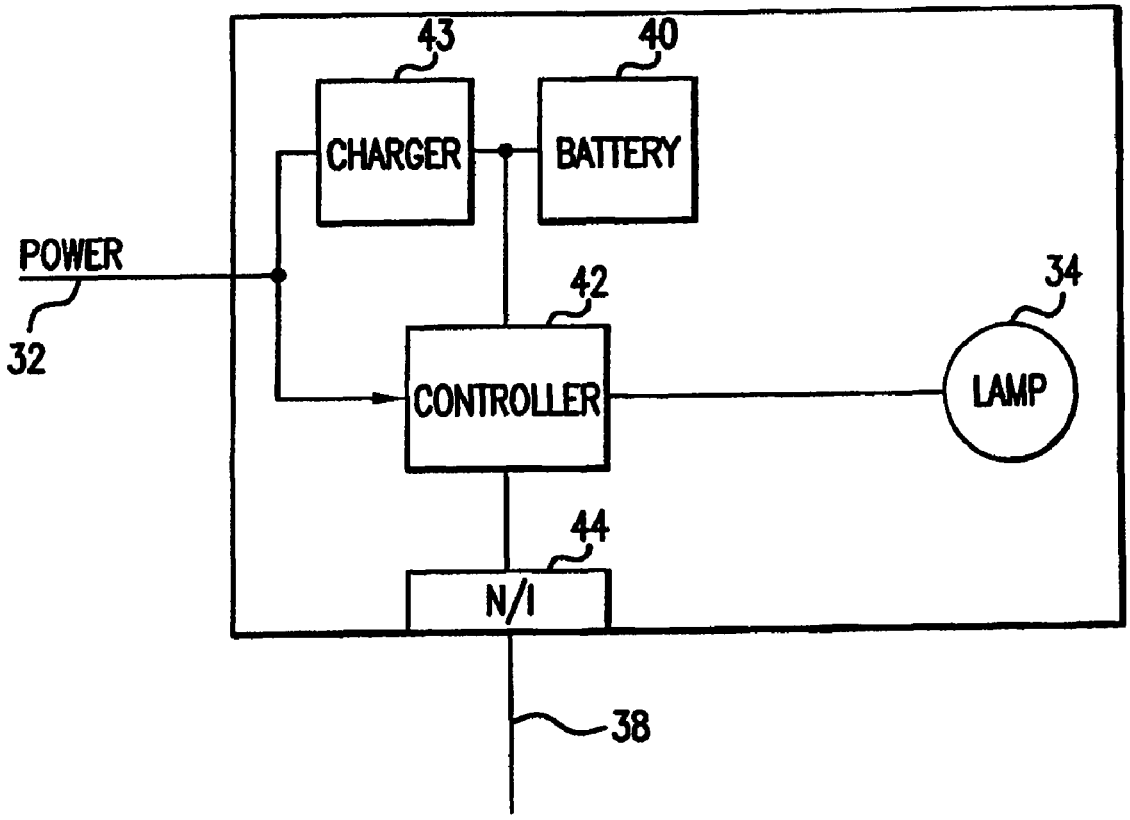
FIG. 3B is a block diagram of an alternative embodiment in which the ELIAM includes a lamp.

FIG. 3B is a block diagram of an alternative embodiment in which the ELIAM 36 includes a lamp 34.

In another embodiment, the fire alarm system can be used to modify the operation of the ELIAMs. For example, the fire alarm control panel may send one or more commands to extend battery standby duration. In particular, the fire alarm control panel may send a command to the ELIAM in order to use a motion sensor local to the ELIAM. The motion sensor or system of motion sensors can be used to activate emergency lights only when lighting is needed. The sensor may be monitored by the fire alarm system, and the fire alarm system may command the ELIAM to activate its light when motion is detected. This conserves available battery capacity for when it is needed rather than consuming capacity when nobody is walking through an area.

Furthermore, a photo sensor could determine if ambient light is sufficient. For example, if a particular corridor is near a window, and daylight is adequate, ELIAMs in the corridor may be controlled to preserve battery capacity.

Similarly, a light sensor may be used to indicate that an emergency light is activated. A properly placed sensor could determine that the lamp actually is energized and providing emergency lighting. Failure of the lamp could thus be reported as a trouble condition.

Since the ELIAM is identified by its system address, a custom label, such as a textual description, can be assigned to the point. This custom label and the system address identify the device and location that require service.

Alternatively, the system can provide the same features and operation described above using a suitably designed notification appliance circuit (NAC) or auxiliary power output point. The required measurement capabilities are described above. In this case, the backup power for the emergency lighting system may come from the fire alarm panel or from a NAC power extender.

Finally, the system provides addressable control of the emergency lighting system, which may be useful during a fire.

While this invention has been particularly shown and described with references to preferred embodiments thereof, it will be understood to those skilled in the art that various changes in form and details may be made therein without departing from the scope of the invention encompassed by the appended claims.

The invention claimed is:

1. In a fire alarm system comprising a fire alarm control panel, a fire alarm network connected to the fire alarm control panel, an emergency exit lighting unit in communication with the fire alarm network, the emergency exit lighting unit comprising a lamp for providing illumination of an exit and/or illumination of the exit route, a backup battery, a controller that connects the backup battery to the lamp upon detection of loss of main power, and a network interface which interfaces with and receives communications from the fire alarm control panel via the fire alarm network, the emergency lighting unit having a unique identifier with respect to the fire alarm network, a method for testing the emergency exit lighting unit, comprising:

receiving, by the emergency lighting unit, a communication sent from the fire alarm control panel related to state information of the emergency lighting unit;

accessing, by the emergency lighting unit, the state information for at least one aspect related to the emergency lighting unit; and sending, by the emergency lighting unit, at least a part of the state information to the fire alarm control panel.

2. The method of claim 1, wherein the communication sent from the fire alarm control panel is a test command.

3. The method of claim 2, wherein the test command comprises a command to test the emergency lighting unit; and wherein, in response to receiving the test command, the emergency lighting unit sends at least a part of the state information to the fire alarm control panel.

4. The method of claim 2, wherein the emergency exit lighting unit is tested on a periodic schedule.

5. The method of claim 1, wherein accessing the state information includes performing a test to generate the state information; and wherein the at least a part of the state information is sent to the fire alarm control panel after generating the state information.

6. The method of claim 1, wherein the state information comprises at least one of status of the battery and state of the lamp .

7. The method of claim 1, wherein the state information comprises an indication of at least one of voltage across the battery or current draw from the battery.

8. The method of claim 6, wherein the state information comprises an indication of at least one of a defective lamp or a bulb in the lamp being burned out.

9. The method of claim 1, where the fire alarm control panel schedules each emergency lighting unit connected to the fire alarm network for testing, and issues a command to each emergency lighting unit to begin testing its respective battery by discharging it and measuring at least one of current and voltage during the discharge time.

10. The method of claim 9, wherein timing of the testing of each of the emergency light units is predetermined.

11. The method of claim 9, wherein the timing comprises a periodic schedule.

12. The method of claim 11, wherein the period schedule is selectable by a user.

13. In a fire alarm system comprising a fire alarm control panel, a fire alarm network connected to the fire alarm control panel, an emergency exit lighting unit in communication with the fire alarm network, the emergency exit lighting unit comprising a lamp for providing illumination of an exit, a backup battery, a controller that connects the backup battery to the lamp upon detection of loss of main power, and a network interface which interfaces with and receives communications from the fire alarm control panel via the fire alarm network, the emergency exit lighting unit having a unique identifier with respect to the fire alarm network, a method for monitoring the emergency exit lighting unit, comprising:

receiving a communication from the fire alarm control panel via the fire alarm network to provide status or to test of the emergency exit lighting unit;

in response to receiving the communication, the emergency exit lighting unit generating information regarding at least one aspect of the emergency exit lighting unit; and sending at least a part of the generated information to the fire alarm control panel.

14. The method of claim 13, wherein generating information regarding at least one aspect of the emergency exit lighting unit comprises generating, by the emergency exit lighting unit, test data regarding testing of the backup battery of the emergency exit lighting unit.

15. The method of claim 14, wherein the communication is a test command to the emergency exit lighting unit to perform a test.

16. The method of claim 14, wherein the communication is a command to the emergency exit lighting unit to report a log of a previously performed test.

17. The method of claim 13, wherein the emergency exit lighting unit is tested monthly.

18. The method of claim 13, wherein the at least one aspect of the emergency exit lighting unit comprises status of the battery and state of the light.

19. The method of claim 13, wherein the fire alarm control panel generates a schedule to test each emergency exit lighting unit within the fire alarm network, and wherein the fire alarm control panel issues a command to each emergency exit lighting unit based on the schedule to test the emergency light unit's respective battery by discharging it and measuring the current and voltage during the discharge time.

20. In a fire alarm system comprising a fire alarm control panel, a fire alarm network connected to the fire alarm control panel, an emergency exit lighting unit in communication with the fire alarm network, the emergency exit lighting unit comprising a lamp for providing illumination of an exit, a backup battery, a controller that connects the backup battery to the lamp upon detection of loss of main power, and a network interface which interfaces with and receives communications from the fire alarm control panel via the fire alarm network, the emergency exit lighting unit having a unique identifier with respect to the fire alarm network, a method for monitoring the emergency exit lighting unit, comprising:

receiving a communication from the fire alarm control panel via the fire alarm network, the communication regarding testing of the emergency exit lighting unit;

in response to receiving the communication, the controller testing the backup battery of the emergency exit lighting unit;

generating, by the emergency exit lighting unit, test data regarding the testing of the backup battery of the emergency exit lighting unit; and sending at least a part of the test data regarding the testing of the backup battery to the fire alarm control panel.

21. The method of claim 20, wherein the communication received from the fire alarm control panel comprises a testing command.

22. The method of claim 1, wherein accessing the state information includes accessing a test log.

23. The method of claim 22, wherein the communication is a command to the emergency exit lighting unit to report the test log.

* * * * *

UNITED STATES PATENT AND TRADEMARK OFFICE

CERTIFICATE OF CORRECTION

PATENT NO. : 7,999,666 B2
APPLICATION NO. : 12/172014
DATED : August 16, 2011
INVENTOR(S) : Barrieau et al.

It is certified that error appears in the above-identified patent and that said Letters Patent is hereby corrected as shown below:

Title page Item (75) Inventors: "Mark B. Barrieau" should be corrected to read "Mark P. Barrieau".

Signed and Sealed this
Twenty-second Day of November, 2011

David J. Kappos
*Director of the United States Patent and Trademark Office*